US005574822A

United States Patent [19]

West

[11] Patent Number: 5,574,822

[45] Date of Patent: Nov. 12, 1996

[54] COMPACT ELECTRIC WATER HEATER

[75] Inventor: Eugene L. West, Grand Rapids, Mich.

[73] Assignee: Bradford White Corporation, Ambler, Pa.

[21] Appl. No.: 34,548

[22] Filed: Mar. 19, 1993

[51] Int. Cl.[6] ..... F24H 1/20

[52] U.S. Cl. ..... 392/451; 392/453; 392/457

[58] Field of Search ..... 219/494, 491; 392/449–453, 457

[56] References Cited

U.S. PATENT DOCUMENTS

| | | | |
|---|---|---|---|
| 2,237,808 | 4/1941 | Berg | 392/451 |
| 3,143,636 | 8/1964 | Lupovici | 219/314 |
| 4,866,250 | 9/1989 | Pasbrig | 219/299 |
| 4,969,420 | 11/1990 | McKeon | 122/17 |
| 5,081,696 | 1/1992 | Beck | 392/449 |
| 5,175,414 | 12/1992 | Hara et al. | 219/528 |
| 5,251,282 | 10/1993 | Hanning et al. | 122/131 |
| 5,313,876 | 5/1994 | Hilger et al. | 99/330 |

*Primary Examiner*—Mark H. Paschall
*Attorney, Agent, or Firm*—Austin R. Miller

[57] ABSTRACT

A water heater including a steel water tank having a bottom plate and a deep drawn body portion welded together, the tank having a glass lining and openings to receive and discharge water; foam insulation surrounding the body portion; an outer covering surrounding the foam insulation; a bottom pan connected to the outer covering adjacent the bottom plate; and a heater connected to the tank. Also disclosed is a method of making a water heater including forming a steel water tank by welding together a bottom plate and a deep drawn body portion; lining the formed steel water tank with a glass coating; placing foam insulation forming liquids into a substantially rigid outer covering to form foam insulation having an interior portion with an open end and sized and shaped to substantially match the shape of the body portion of the water tank; positioning the water tank into the interior portion of the foam insulation; and covering the bottom plate of the water tank with a bottom pan and connecting the bottom pan to the outer covering.

11 Claims, 5 Drawing Sheets

COMPACT ELECTRIC WATER HEATER

BACKGROUND OF THE INVENTION

The present invention relates to an electric water heater, particularly to a compact insulated water heater adapted to fit into limited spaces.

FIELD OF THE INVENTION

Heated water is frequently required in remote locations and/or under conditions such that a limited quantity of heated water will be sufficient for the task at hand. Such locations typically include factories, stores, cabins, recreational vehicles, offices, boats and the like. Bathrooms, sinks and showers are frequently located remotely from the water heater in many houses, such as ranch houses, for example. The result is that a large quantity of cold water lies in the water line which must be purged before hot water reaches the point of use. This is both inconvenient and wasteful, especially in view of increasing occurrences of water scarcity.

In some instances, only a small amount of heated water is desirable for use at a particular time. For example, a small sink or lavatory for hand washing may be all that is required at a particular location. Similarly, many locations have severe size limitations which prevent installation of typical large water heaters.

Such requirements have produced the need for a compact water heater capable of all of the functions of larger water heaters, except the quantity of water stored or delivered.

Creating such a water heater at reasonable cost has been difficult in view of the installation requirements typical of many water heaters, such as the need for installation space for hookups, tools required for installation and ease of installation. Also, many such water heaters are subjected to harsh environmental conditions which can degrade performance and lead to premature failure.

OBJECTS OF THE INVENTION

It is an object of the present invention to provide a water heater capable of installation and operation in severely limited space locations.

It is another object of the present invention to provide a water heater capable of resisting corrosion.

It is a further object of the present invention to provide a compact water heater which is easily manufactured in mass quantities and at low cost.

It is still another object of the present invention to provide a water heater capable of use at remote locations wherein limited quantities of heated water are needed.

Other objects and advantages of the present invention will become apparent to those skilled in the art from the drawings, the detailed description of preferred embodiments and the appended claims.

SUMMARY OF THE INVENTION

The present invention provides a water heater including a steel water tank having a one-piece deep drawn body portion which is welded to a bottom plate. The interior of the tank has a glass lining and openings to receive and discharge water. Foam insulation surrounds the body portion and an outer covering surrounds the foam insulation. A bottom pan connects to the outer covering adjacent the bottom plate and an electric heating element is connected to heat water in the tank.

The invention further provides for a method of making a compact water heater including the steps of forming a steel water tank by deep-drawing a steel plate to form a one-piece body portion and welding it to a bottom plate, lining the formed steel water tank with a glass coating, placing foam-forming liquids into a substantially rigid outer covering to form foam insulation having an interior portion with an open end and sized and shaped to substantially match the shape of the body portion of the water tank, before or after forming the insulation positioning the water tank into the interior portion of the outer covering, covering the bottom plate of the water tank with a bottom pan and connecting the bottom pan to the outer covering.

DETAILED DESCRIPTION OF THE INVENTION

Figure 1:
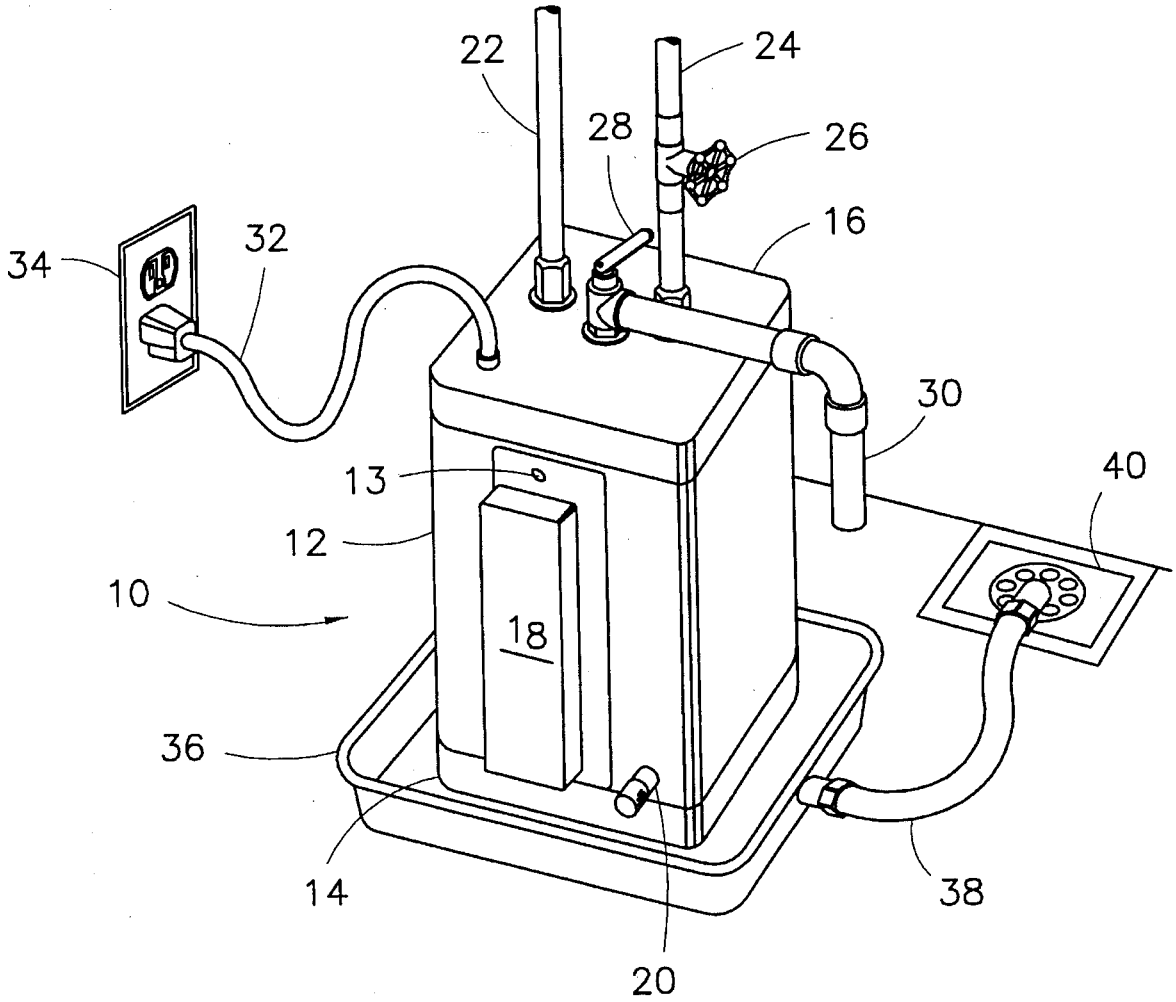
FIG. 1 is a schematic perspective view of a water heater in accordance with aspects of the invention.

It will be appreciated that the following description is intended to refer to the specific embodiments of the invention selected for illustration in the drawings and is not intended to define or to limit the invention, other than in the appended claims.

Turning now to the specific forms of the invention illustrated in the drawings and referring particularly to FIG. 1, the number 10 designates one form of water heater in accordance with the invention. Water heater 10 includes an outer jacket 12, a bottom pan 14 and a top cover 16. Thermostat cover 18 connects to outer jacket 12 with screw 13 and drain valve 20 extends outwardly from a lower portion of outer jacket 12.

At the top of water heater 10, water inlet line 22 and hot water outlet line 24 connect to plumbing (not shown) in the surrounding building. Cold water inlet line 22 has a valve 26. Pressure relief valve 28 also extends upwardly from top cover 16 and connects to relief line 30. Power cord 32 extends between outlet 34 and top cover 16.

Water heater 10 is positioned in a catch pan 36, which has a water outlet line 38 connected to floor drain 40.

Figure 2:
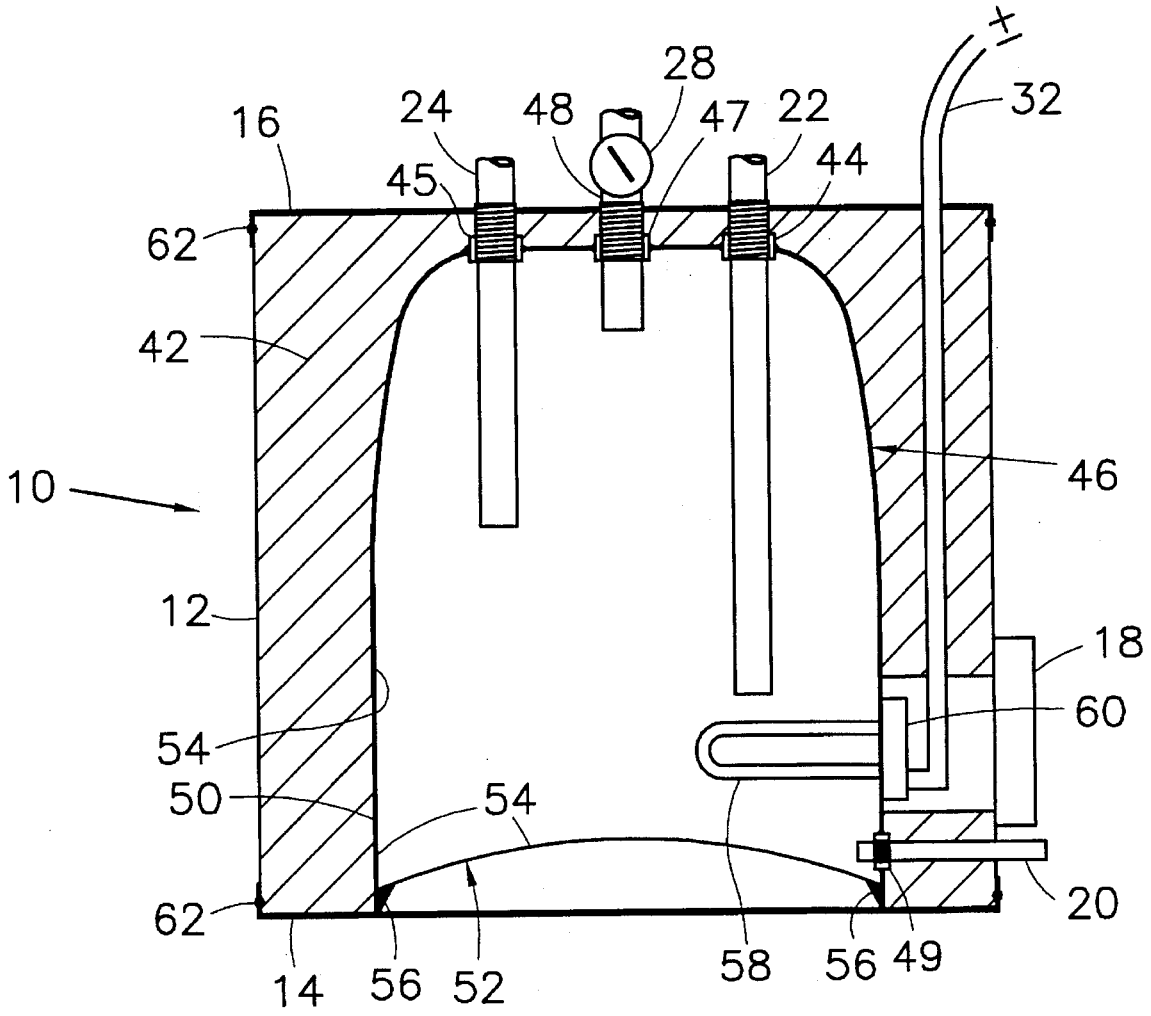
FIG. 2 is a side elevational view, partly taken in section, of the water heater shown in FIG. 1.

FIG. 2 shows interior portions of the water heater 10 of FIG. 1. Water inlet line 22 is shown extending through top cover 16, precast foam insulation 42, spud 44 and into water tank 46. Similarly, hot water outlet line 24 is shown extending through top cover 16, precast foam insulation 42, spud 45 and into tank 46. Also, pressure relief valve 28 is shown connected to pressure line 48 which extends through top cover 16, spud 47 and into water tank 46.

Water tank 46 includes deep drawn body 50 and bottom 52. A glass lining 54 covers the interior surface of deep drawn body 50 and bottom 52. Deep drawn body 50 and bottom 52 are sealed together by weld 56.

Drain valve 20 extends through outer jacket 12, precast foam insulation 42, spud 49 and into the bottom portion of water tank 46. Similarly, heating element 58 extends into water tank 56 and is electrically connected to thermostat 60. Power cord 32 connects to thermostat 60.

Bottom 52 rests on bottom pan 14, which connects to outer jacket 12 by rivet 62. Similarly, top pan 16 connects to outer jacket 12 with rivet 62.

Figure 3:
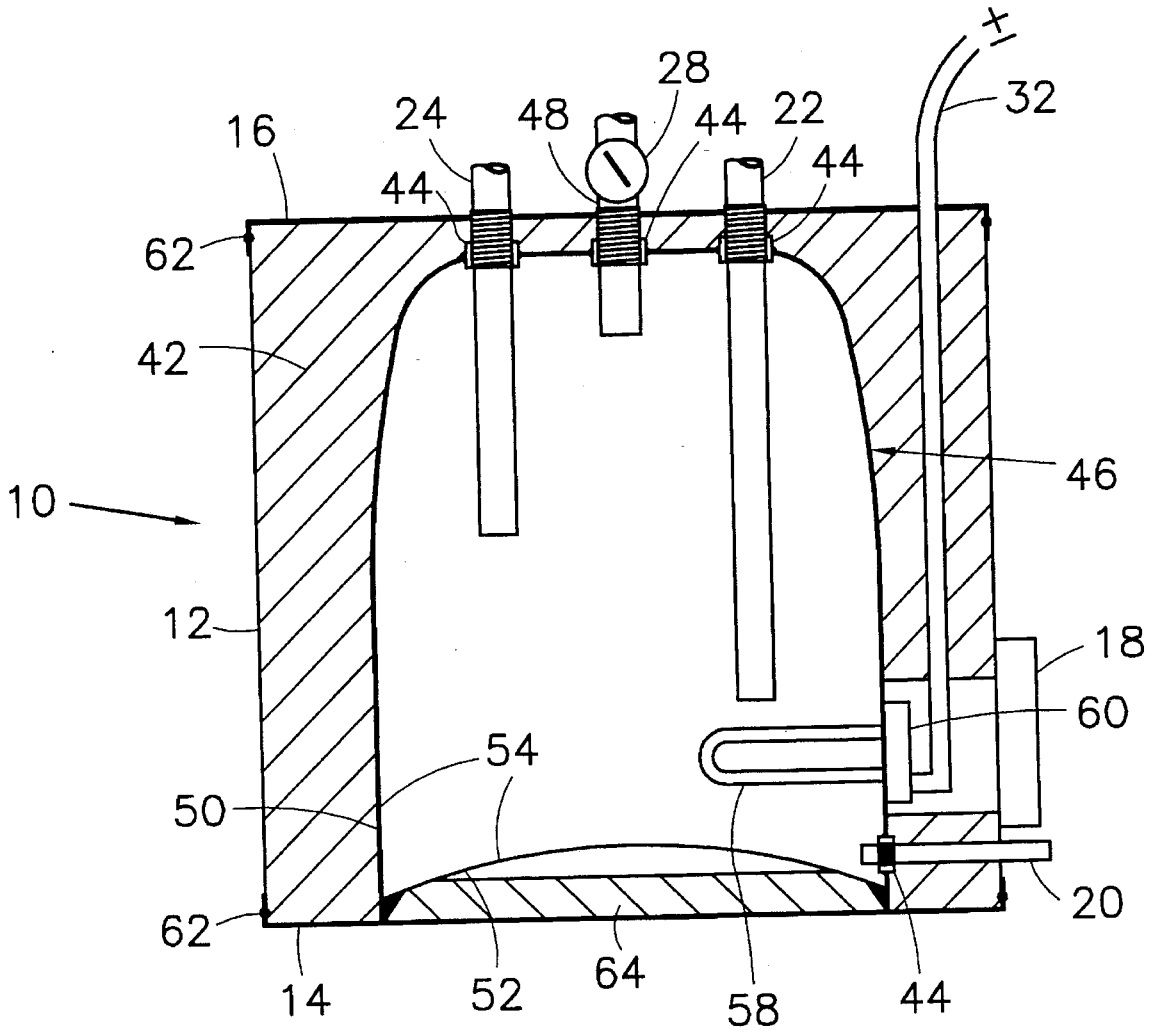
FIG. 3 is a side elevational view similar to FIG. 2, partly taken in section, of another embodiment of a water heater in accordance with the invention.

FIG. 3 is similar to FIG. 2 except that expanded bead polystyrene insulation 64 or the like is interposed between bottom 52 and bottom pan 14.

FIGS. 4–7 show several embodiments of the weld 56 and glass lining 54 at the point of connection between deep drawn body 50 and bottom 52.

Figure 4:
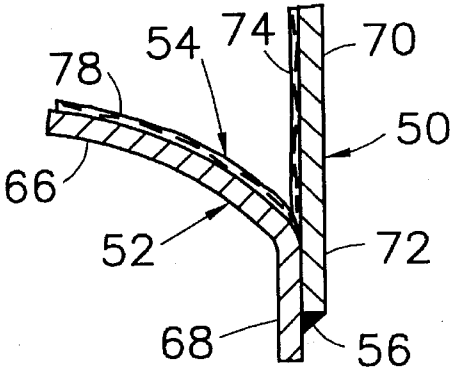
FIG. 4 is a partial cross-sectional view of a portion of a deep drawn body and a base plate weld joint embodying features of the invention.

Referring to FIG. 4, bottom 52 is inclusive of dome-shaped base 66 and base flange 68. Deep drawn body 50 includes wall 70 and tank flange 72. Glass lining 54 includes wall coating 74 and base coating 78 which can be applied in a method which includes applying a wet coating of enamel to the dome-shaped base 66 and wall 70 first, then drying base 66 and wall 70 separately, then firing base 66 and wall 70 separately and then welding flanges 68 and 72 at weld 56.

Figure 6:
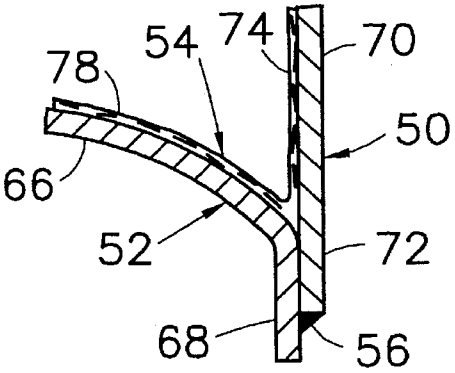
FIG. 6 is a partial cross-sectional view of a welded connection joint between a deep drawn body and a base plate in accordance with the invention after firing the glass lining.
Figure 5:
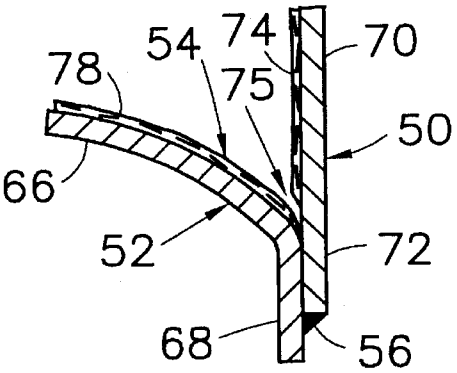
FIG. 5 is a partial cross-sectional view similar to FIG. 4, showing the relationship of the parts prior to firing the glass lining.

FIGS. 5 and 6 include many of the aspects shown in FIG. 4 except that an alternate method is shown. The method includes first separately wet coating and separately drying base 66 and wall 70 (which leaves a gap 75), then welding flanges 68 and 72 at weld 56 and then firing the welded unit. Thus, in FIG. 5 the glass lining on wall 70 has wall coating 74 and dome-shaped base 66 has a base coating 78 with small gap 75 prior to firing. In FIG. 6, firing melts the coatings and closes the gap.

The nature and structure of the novel compact water heater of this invention will be further understood with respect to the manner in which it may be made. One method for constructing water heater 10 is described below in conjunction with all of the drawings.

In one preferred embodiment of water heater having a particularized exterior, outer jacket 12 is extruded from a vinyl plastic-type material in a manner known in the extrusion art and not discussed herein. Long sections of the extruded plastic material are cut to a desired jacket length which will precisely match a water tank of a desired length and a desired amount and thickness of insulation. Then, top cover 16 is lowered over the upper edges of outer jacket 12 and into a secure position. Any number of securing devices such as screws, rivets, adhesive, glues and the like may be used to tightly secure top cover 16 to outer jacket 12. Top cover 16 is preferably tightly seated over the top edge of outer jacket 12 to prevent foam leakage.

Figure 7:
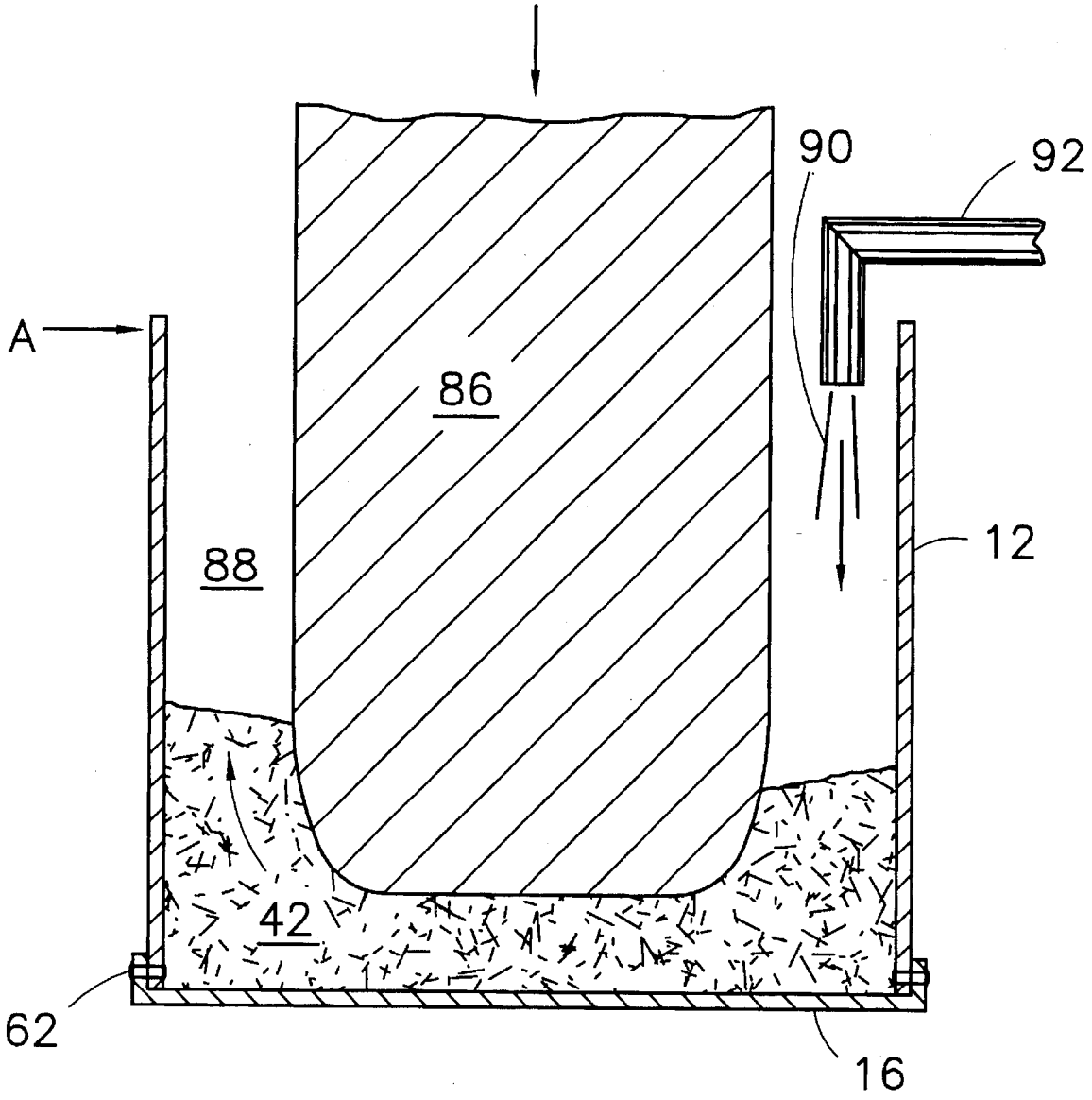
FIG. 7 is a schematic front elevational view, partly taken in section, of one step of manufacturing a water heater in accordance with the invention.

In a preferred method, outer jacket 12 and top cover 16 are inverted as shown in FIG. 7 of the drawings and a die 86 is lowered into the interior space 88. Foam forming liquids 90 are then injected by way of nozzle 92 into interior space 88. The amount of foam forming liquids 90 is predetermined such that upon complete formation of foam insulation from foam forming liquids 90, substantially the entire interior space 88 is filled with high efficiency foam insulation. The point illustrated by the arrow labeled "A" is a preferred final quantity of foam to fill interior space 88. The foam forming liquids 90 are permitted to expand upwardly to fill interior space 88 and set or cure, as necessary and known in the art. Die 86 may then be removed at a time such that foam insulation 42 will not adhere to its sides. However, it is preferred that the foam insulation 42 adhere to the interior surfaces of outer jacket 12 and top cover 16, although it is not mandatory. It is further possible to form foam insulation 42 in a container other than outer jacket 12 and top cover 16 so long as the container has an interior shape and size substantially the same as outer jacket 12 and top cover 16.

Deep drawn body 50 is preferably formed by deep drawing a steel plate of a precalculated size to result in a test tube-shaped tank-like container of a desired capacity. Various methods of deep drawing are known in the metal working art and are not discussed herein.

The deep drawn body 50 is advantageously welded to bottom plate 52 to create a single weld water tank 46. The welding method and manner may be of any type of weld known in the art and the weld location may be varied, although the location of weld 56 is preferably as shown in FIGS. 4–6. Spuds 44, 45, 47 and 49 are also welded into desired positions subsequent to punching or drilling holes in the deep drawn body so that cold water in line 24, hot water exit line 22, pressure line 48, heating element 58 and drain valve 20 may be applied and secured in the usual manner.

It is possible in accordance with further steps of the invention to apply glass lining 54 in a number of different steps relating to the step of welding bottom plate 52 to deep drawn body 50. For example, in one preferred step, weld 56 is applied to bottom plate 52 and deep drawn body 50 prior to application of glass lining 54. Glass lining 54 may be of any type well known in the art, such as VITRAGLASS®. Of course, in applying a glass lining 54 such as VITRAGLASS®, a coating of glass is first applied to form a so-called "bisque" which is then fired or sintered at high temperature to cure the glass lining 54. In one method of applying coating 74, coating 74 is applied to wall 70 separate from application of coating 78 to base 66. Of course, these coatings are applied prior to welding flanges 68 and 72 together at weld 56. Both coatings 74 and 78 are further separately permitted to dry into a "bisque" and are further separately fired prior to welding of flanges 68 and 72.

In another embodiment, coatings 74 and 78 are applied to wall 70 and base 66, respectively, prior to welding of flanges 68 and 72. Both coatings 74 and 78 are dried into a "bisque" prior to welding at weld 56. Then flanges 68 and 72 are welded together at weld 56 and then the welded unit is fired with the resulting integral coating 54 shown in FIG. 6.

In still another embodiment, flanges 68 and 72 are first welded prior to application of coatings 74 and 78. Then coatings 74 and 78 are coated onto wall 70 and base 66, respectively, dried, and then fired to form integral coating 54 as shown in FIG. 6.

In still another embodiment, each coating 74 and 78 is applied to wall 70 and base 66 prior to welding. Then one of the two coatings 74 and 78 is permitted to dry into a "bisque" while the other is not. Then flanges 68 and 72 are welded, the wet coating is permitted to dry, and firing is applied to form integral coating 54 as shown in FIG. 6.

It is further preferred (but not mandatory) that the various fittings such as spuds 44, 45, 47 and 49 are welded to deep drawn body 50 prior to application of glass lining 54 to enhance corrosion resistance at the respective welds.

Once glass lining 54 has been applied as described above, the various fittings may be applied through top cover 16, precast foam insulation 42 and into water tank 46. For example, hot water exit line 24 (FIGS. 1–3) and cold water inlet line 22 may be connected into spuds 44 and 45, respectively. Similarly, pressure line 48 may be applied through top cover 16 and precast foam insulation 42 and into water tank 46. However, it is also within the scope of the invention that hot water exit line 24, cold water inlet line 22, pressure line 48, heating element 58 and/or drain valve 20 may be connected to water tank 46 prior to the foaming step.

After or before the various connected items are applied to water tank 46, water tank 46 is inserted into the interior space of precast foam insulation 42. Then, bottom pan 14 is applied over the open end of outer jacket 12 and secured into place by any means known in the art, such as by rivets 62 (FIGS. 2 and 3), for example. As shown in FIG. 3, a further layer of insulation 64 may be applied between bottom plate 52 and bottom pan 14 to further enhance the thermal capabilities of the water heater. Such insulation is typically in the form of an expanded bead polystyrene disk, although it is possible to apply other precast foam insulation pieces, fiberglass or their equivalent if desired. Then, bottom pan 14 is secured to outer jacket 12 in a known manner to cover insulation 64.

The resulting water heater 10 is a compact, highly thermally efficient unit which is comparatively simple to manufacture and is highly durable because it has no longitudinal weld and no head weld as in typical commercially available water heaters. The water heater provides for remotely located sources of heated water at positions not otherwise capable of easy access and reduces wasteful use of water while cold water travels to remote points of use. Simplified and improved water tank construction, such as the use of a single circumferential weld and particularized use of construction materials, such as extruded plastic outer jackets, significantly improve long term corrosion resistance.

Although this invention has been described in connection with specific forms thereof, it will be appreciated that a wide variety of equivalents may be substituted for the specific elements shown and described herein without departing from the spirit and scope of this invention as described in the appended claims.

For example, the bottom of the water tank 46 may have various shapes, either with lower flanges as shown in the Figures or as a flat construction. Various other modifications may be made, including the use of a variety of fiberglass and foam insulating materials, tank insulating and foaming techniques and the use of jackets, tanks and bottom pans of various designs and shapes. Further, variations may be made in the sequence of steps of the method, all without departing from the spirit and scope of the invention as defined in the appended claims. For example, although it is preferred to utilize an extruded vinyl material for outer jacket 12, other materials, such as extruded or rolled metals such as steel may be used. Also, bottom pan 16 and top cover 14 may be deep drawn or the like or metal rather than plastic. Various types of heating elements 58 and thermostats 60 may be used so long as they supply the proper control and heating capabilities of the water heater.

What is claimed is:

1. A method of making a water heater comprising:

forming a steel water tank by welding together a bottom plate and a substantially tubular deep drawn body portion having an open end and a rounded integral closed end;

lining the formed steel water tank on its interior surface with a glass coating;

placing foam insulation forming liquids into a substantially rigid outer covering and separably about a die to form foam insulation having an interior portion with an open end and sized and shaped to substantially match the shape of said body portion of said water tank;

separating said die and said foam insulation;

positioning said water tank into the interior portion of said foam insulation; and covering said bottom plate of said water tank with a bottom pan and connecting said bottom pan to said outer covering.

2. The method defined in claim 1 further comprising positioning insulation between said bottom plate and said bottom pan.

3. The method defined in claim 1 further comprising affixing means to heat water to said water tank.

4. The method defined in claim 1 further comprising extruding a seamless vinyl jacket and connecting one open end thereof to a top pan to form said rigid outer covering.

5. The method defined in claim 1 further comprising firing the glass coating after lining.

6. A method of making a water heater comprising:

deep drawing a steel workpiece into a body portion;

coating an interior surface of said deep drawn steel body portion with glass;

coating a side of a steel bottom plate with glass;

welding together said bottom plate and said deep drawn body portion to form a steel water tank;

placing foam insulation forming liquids into a substantially rigid outer covering and separably about a die to form foam insulation having an open interior portion with an open end and sized and shaped to substantially match the shape of said body portion of said water tank;

separating said die and said foam insulation;

positioning said water tank into the interior portion of said foam insulation; and covering said bottom plate of said water tank with a bottom pan and connecting said bottom pan to said outer covering.

7. The method defined in claim 6 further comprising positioning insulation between said bottom plate and said bottom pan.

8. The method defined in claim 6 further comprising affixing means to heat water to said water tank.

9. The method defined in claim 6 further comprising extruding a seamless vinyl jacket and connecting one open end thereof to a top pan to form said rigid outer covering.

10. The method defined in claim 6 further comprising firing the glass coated bottom plate and deep drawn body portion before welding.

11. The method defined in claim 6 further comprising firing the glass coated bottom plate and deep drawn body portion after welding.

* * * * *